US008413622B2

(12) United States Patent
Noda et al.

(10) Patent No.: US 8,413,622 B2
(45) Date of Patent: Apr. 9, 2013

(54) OIL SUPPLY DEVICE OF ENGINE

(75) Inventors: Akihiro Noda, Hiroshima (JP); Tomoya Tanaka, Hiroshima (JP)

(73) Assignee: Mazda Motor Corporation (JP)

( * ) Notice: Subject to any disclaimer, the term of this patent is extended or adjusted under 35 U.S.C. 154(b) by 162 days.

(21) Appl. No.: 13/166,665

(22) Filed: Jun. 22, 2011

(65) Prior Publication Data

US 2011/0315106 A1 Dec. 29, 2011

(30) Foreign Application Priority Data

Jun. 29, 2010 (JP) ..... 2010-147164
Apr. 19, 2011 (JP) ..... 2011-092924

(51) Int. Cl.
*F01L 9/02* (2006.01)

(52) U.S. Cl. ..... 123/90.12; 123/90.13; 123/90.33; 123/90.45; 123/90.46; 123/90.52

(58) Field of Classification Search ..... 123/90.12, 123/90.13, 90.33, 90.45, 90.46, 90.52
See application file for complete search history.

(56) References Cited

U.S. PATENT DOCUMENTS 7,455,040 B2 * 11/2008 Hendriksma et al. ..... 123/90.34

FOREIGN PATENT DOCUMENTS

JP 05-306603 11/1993
JP 2008-106701 A 5/2008

* cited by examiner

*Primary Examiner* — Ching Chang
(74) *Attorney, Agent, or Firm* — Studebaker & Brackett PC; Donald R. Studebaker

(57) ABSTRACT

There are provided first and second extending oil passages supplying operational oil to intake-side and exhaust-side lash adjustors, a first connection oil passage interconnecting one end portions of the oil passages, and an oil-pressure control valve selecting a first state in which the first extending oil passage does not connect to a drain oil passage or a second state in which the first extending oil passage connects to the drain oil passage. An orifice is provided in an oil passage which is located on the side of the first connection oil passage relative to a supply portion of the operational oil supplied to the lash adjustor and located on the side of the first connection oil passage relative to another supply portion of the operational oil supplied to the lash adjustor.

10 Claims, 5 Drawing Sheets

OIL SUPPLY DEVICE OF ENGINE

BACKGROUND OF THE INVENTION

The present invention relates to an oil supply device of an engine equipped with a variable valve-drive mechanism which selects valve characteristics by using operational oil supplied through one of lash adjustors respectively provided at valve drive portions located on an intake side and an exhaust side.

Conventionally, a valve drive mechanism of an engine, in which lash adjustors are provided at valve drive portions of the engine and oil is supplied to the lash adjustors from an oil-pressure supply system including an oil pump as operational oil to automatically adjust valve clearances, is known as shown in Japanese Patent Laid-Open Publication No. 5-306603.

The oil pressure supplied to the lash adjustors is required to be maintained at an appropriate value so that the performance of the valve drive portions can be proper. Then, according to the device disclosed in Japanese Patent Laid-Open Publication No. 2008-106701, for example, a properly-high oil pressure supplied to the lash adjustors can be ensured by stopping or restricting some oil supplying to the other parts than the lash adjustors when the oil pressure of the oil-pressure supply system decreases.

Further, some engines equipped with a variable valve-drive mechanism which selects valve characteristics, such as valve lift or valve timing, in accordance with an engine running condition are known as well. In some type of engines among these, the valve characteristics are selectable by supplying the operational oil through the lash adjustors at the valve drive portions (see US Patent Application Publication No. 2008/230023, for example).

In the case of supplying the operational oil to the variable vale drive mechanism through the lash adjustors at the valve drive portions as shown in the above-described US patent document, there is a problem in that when the valve characteristics are selected by the variable vale drive mechanism (to decrease the oil pressure), the pressure of the oil supplied to the lash adjustors decreases accordingly, so that the valve clearances may not be kept at an appropriate value. Herein, since it is required to decrease the oil pressure quickly for a prompt selection of the valve characteristics, it may be considered that the oil passage to supply the oil pressure to the lash adjustors is made open so as to connect to a drain oil passage by a valve, for example. In this case, however, the oil pressure supplied to the lash adjustors may decrease extremely. Thus, the requirement of the oil pressure for the selection of the valve characteristics is substantially different from the requirement of the oil pressure for the lash adjustors, so there was still some room for improvement in order to meet the both requirements.

SUMMARY OF THE INVENTION

The present invention has been devised in view of the above-described matter, and an object of the present invention is to provide an oil supply device of an engine which can select the valve characteristics promptly, keeping the oil pressure supplied to the lash adjustor at the appropriate value.

According to the present invention, there is provided an oil supply device of an engine, comprising lash adjustors respectively provided at valve drive portions located on an intake side and an exhaust side of a cylinder, a first extending oil passage supplying operational oil to one of the lash adjustors, a second extending oil passage supplying operational oil to the other of the lash adjustors, a first connection oil passage interconnecting respective one end portions of the first and second extending oil passages, a variable valve-drive mechanism selecting valve characteristics by using the operational oil supplied through the one of the lash adjustors, an oil-pressure control valve provided at the other end portion of the first extending oil passage and selecting a first state in which the first extending oil passage does not connect to a drain oil passage or a second state in which the first extending oil passage connects to the drain oil passage, and an orifice provided in an oil passage which is located on the side of the first connection oil passage relative to a supply portion of the operational oil supplied to the one of the lash adjustors provided on the side of the one end portion of the first extending oil passage and located on the side of the first connection oil passage relative to another supply portion of the operational oil supplied to the other of the lash adjustors provided on the side of the one end portion of the second extending oil passage.

According to the present invention, in the first state in which connection of the first extending oil passage and the drain oil passage is shut off by the oil-pressure control valve, that is, the first extending oil passage does not connect to the drain oil passage, the oil pressure of the first and second extending oil passages is kept at the same and high pressure, and thus the high oil pressure is supplied to the one of the lash adjustors and the variable valve drive mechanism and the other of the lash adjustors. In this case, the valve characteristics selected by the variable valve drive mechanism is the first valve characteristics. Then, if the state is changed to the second state in which the first extending oil passage connects to the drain oil passage by the oil-pressure control valve, the oil pressure of the first extending oil passage decreases quickly in accordance with the change of the valve characteristics from the first valve characteristics to the second valve characteristics. Herein, the oil pressure of the first extending oil passage can be kept at a level of pressure to maintain the valve clearance at an appropriate value by the orifice. Accordingly, the valve characteristics can be promptly selected by the variable valve drive mechanism, keeping the oil pressure supplied to the one of the lash adjustors at the appropriate value. Further, since the oil pressure of the second extending oil passage after the selection to the second valve characteristics is maintained at a higher pressure than the pressure of the first extending oil passage by the orifice, the oil pressure supplied to the other of the lash adjustors can be kept at the appropriate value as well. Moreover, since the state becomes the above-described first state when the valve characteristics are selected from the second valve characteristics to the first valve characteristics, the high oil pressure is promptly supplied to the first extending oil passage.

According to an embodiment of the present invention, the oil supply device of an engine further comprises shower pipes ejecting the operational oil supplied from the first connection oil passage over the valve drive portions from above, wherein the orifice is provided on the side of the first extending oil passage relative to connection portions between the shower pipes and the first connection oil passage. Thereby, the oil can be supplied to the shower pipes from the first connection oil passage without providing any additional supply passage. By the above-described structure of the orifice, the sufficient amount of oil supplied to the shower pipes from the first connection oil passage can be ensured.

According to another embodiment of the present invention, the oil supply device of an engine further comprises a second connection oil passage interconnecting the other end portion of the second extending oil passage and a disposition portion of the oil-pressure control valve, wherein the second connection oil passage connects to the other end portion of the first extending oil passage in the first state. Thereby, since the second connection oil passage connects to the other end portion of the first extending oil passage in the first state, the oil pressure supplied to the one of the valve drive portions can increase quickly. Accordingly, the responsiveness of selection of the valve characteristics by the variable valve drive mechanism can be improved effectively.

According to another embodiment of the present invention, the oil supply device of an engine further comprises a second connection oil passage interconnecting the other end portion of the second extending oil passage and a disposition portion of the oil-pressure control valve, a supercharger provided on the side of the first extending passage to supercharge intake air supplied into the cylinder, and a supercharger connection oil passage connecting the second connection oil passage and the supercharger. Thereby, the operational oil can be easily and properly supplied to the supercharger via the supercharger connection oil passage from the second connection oil passage in the first state. Further, even when the valve characteristics are selected by the oil-pressure control valve, the proper oil supply to the supercharger can be provided. While the oil pressure of the first extending oil passage changes in accordance with the selection of the valve characteristics by the oil-pressure control valve, the change of the oil pressure of the second connection oil passage during the selection of the valve characteristics is rather small. Accordingly, the proper oil supply to the supercharger can be provided.

According to another embodiment of the present invention, the first state is set at a low-load and low-speed engine running condition, and the second state is set at the other engine running condition. Herein, the engine running area in which the oil pressure is required for the first extending oil passage (the variable valve drive mechanism) is an engine low-speed area. Meanwhile, the engine running area in which a large amount of oil is required for the supercharger is an engine high-speed area. Thus, since the respective engine-running speed areas in which the first extending oil passage (the variable valve drive mechanism) and the supercharger require the oil are different from each other, the oil supply to the supercharger can be restrained from being delayed when the state is changed from the first state to the second state, in particular.

Other features, aspects, and advantages of the present invention will become apparent from the following description which refers to the accompanying drawings.

DETAILED DESCRIPTION OF THE INVENTION

Hereinafter, a preferred embodiment of the present invention will be descried referring to the accompanying drawings.

Figure 1:
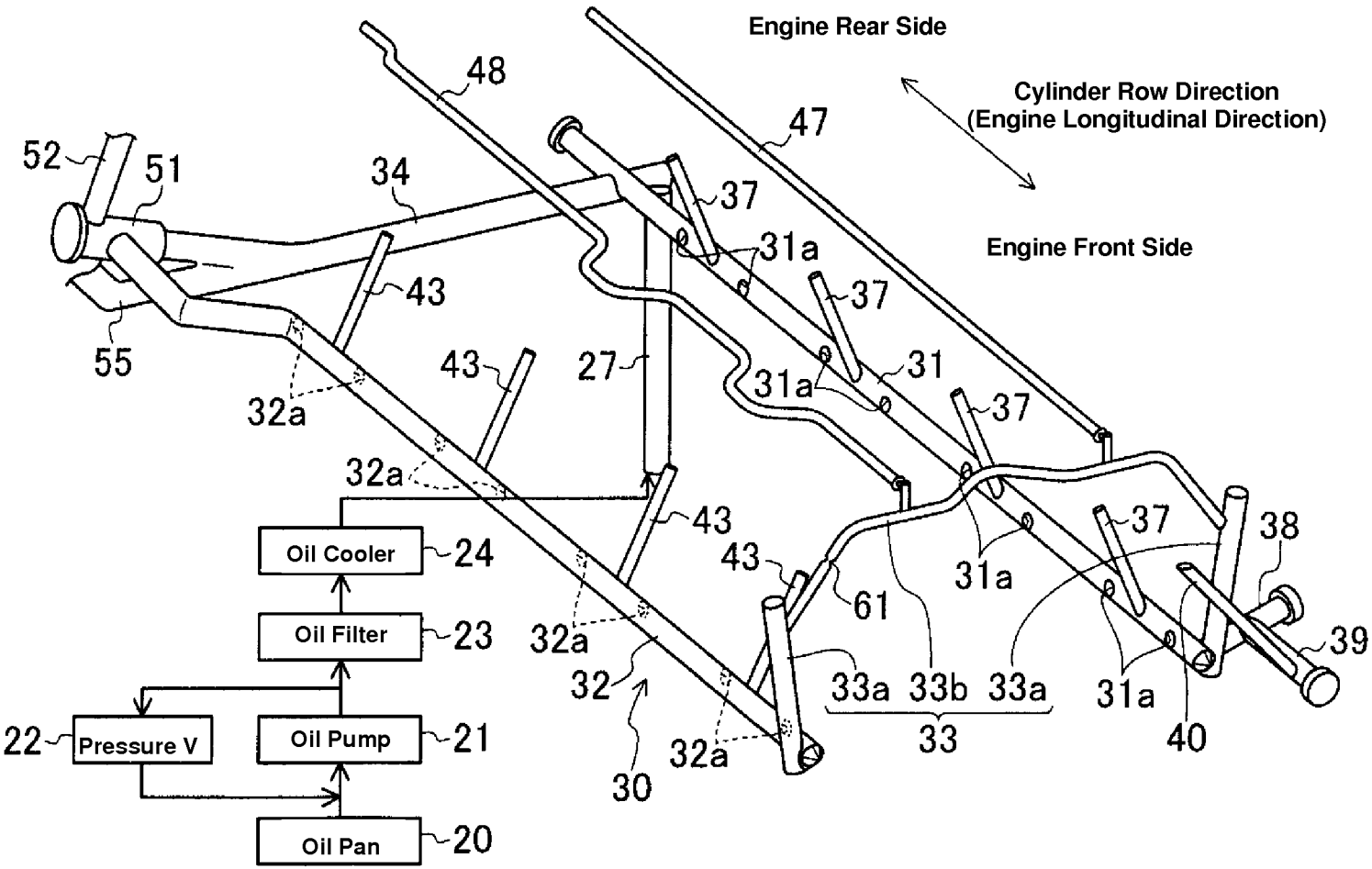
FIG. 1 is a perspective view showing an embodiment of an oil supply device of an engine according to the present invention.
Figure 2:
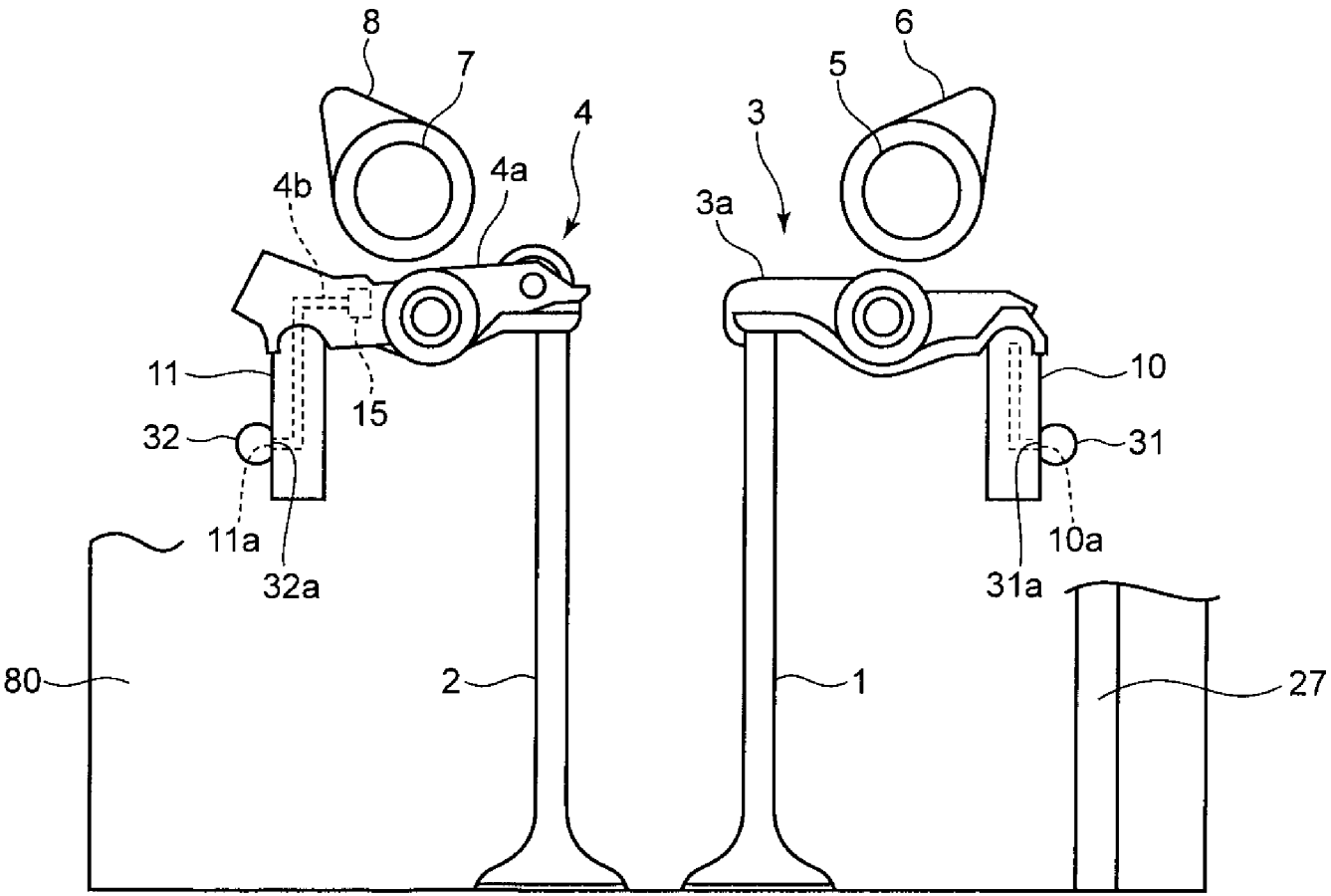
FIG. 2 is a schematic view of valve drive portions located on an intake side and an exhaust side, when viewed from an engine front side.

FIGS. 1 and 2 show an oil supply device of an engine according to the embodiment of the present invention. The engine to which the present oil supply device is applied is an inline multi-cylinder engine which has plural cylinders arranged in line in an engine longitudinal direction (a four-cylinder engine in the present embodiment), and comprises two intake valves 1 and two exhaust valves 2 for each cylinder.

The intake valves 1 are driven by an intake-side valve drive portion 3 which includes an intake-side rocker arm 3*a*. The exhaust valves 2 are driven by an exhaust-side valve drive portion 4 which includes an exhaust-side rocker arm 4*a*. The rocker arm 3*a* of the intake-side valve drive portion 3 is driven by a cam 6 which is provided at a specified portion of an intake camshaft 5 which corresponds thereto. The rocker arm 4*a* of the exhaust-side valve drive portion 4 is driven by a cam 8 which is provided at a specified portion of an exhaust camshaft 7 which corresponds thereto. Herein, an output-side end of a crankshaft of the engine is located on an engine rear side (on the left-and-back side in FIG. 1), and its opposite end is located on an engine front side (on the right-and-front side in FIG. 1).

An intake-side lash adjustor 10 is provided at each of the intake-side valve drive portions 3, and an exhaust-side lash adjustor 11 is provided at each of the exhaust-side valve drive portions 4. These lash adjustors 10, 11, specific illustrations of which are omitted, are configured such that each plunger is movably inserted into each body. Part of oil supplied by an oil pump is supplied to these lash adjustors 10, 11 as operational oil as described below and applied to the each plunger so as to press each one-end portion of the rocker arms 3*a*, 4*a*. Thereby, a clearance (gap) between the other end portion of the intake-side rocker arm 3*a* and the intake valve 1 and a clearance (gap) between the other end portion of the exhaust-side rocker arm 4*a* and the exhaust valve 2 are adjusted, respectively. Thus, an automatic adjustment of the valve clearance is achieved.

The above-described oil supply device comprises an oil pump 21 which is provided at an engine-front-side portion of a cylinder block of the engine to suck oil in an oil pan 20 arranged below the cylinder block and discharge the oil. The oil pump 21 supplies the oil from the oil pan 20 to various engine's sliding portions as lubricating oil, and to some oil-pressure use components, such as the above-described lash adjustors 10, 11 and a variable valve drive mechanism 15, which will be described later, as operational oil. Herein, a pressure valve 22 and the oil pump 21 are arranged in a row. The pressure valve 22 is configured to open when the oil pressure of a first specified value or greater acts thereon so that part of the oil discharged from the oil pump 21 is returned to the oil pump 20, thereby maintaining the oil pressure at the first specified value.

The oil discharged from the oil pump 21 flows down through an oil filter 23 and an oil cooler 24 which are provided at an intake-side portion of a central portion of the cylinder block in the engine longitudinal direction in order, and is supplied to a lower end portion of a supply oil passage 27 which extends vertically at an intake-side portion of a cylinder head 80 (see FIG. 2) which is arranged above the cylinder block. An upper end portion of the supply oil passage 27 is connected to an end portion (a rear end portion of the engine) of an intake-side extending oil passage 31 which extends straightly in the direction of cylinder arrangement (the direction shown by an arrow in FIG. 1 (the engine longitudinal direction), the direction perpendicular to a paper in FIG. 2) at the intake-side portion of the cylinder head 80.

At an exhaust-side portion of the cylinder head is provided an exhaust-side extending oil passage 32 which extends in the cylinder arrangement direction in parallel to the intake-side extending oil passage 31. This exhaust-side extending oil passage 32 is arranged to extend straightly in the cylinder arrangement direction except for the engine's rear end portion.

One end portions (engine front-side end portions) of the above-described extending oil passages 31, 32 are interconnected by a front-side connection oil passage 33, and the other end portions (engine rear-side end portions) of the above-described extending oil passages 31, 32 are interconnected by a rear-side connection oil passage 34. Thus, a closed-loop oil passage 30 is formed in the cylinder head 80 by the above-described extending oil passages 31, 32 and connection oil passages 33, 34.

Eight, in total, oil supply ports 31*a* to supply the oil to the intake-side lash adjustors 10 at the intake-side valve drive portions 3 respectively open at a one side of the intake-side extending oil passage 31 which faces the exhaust-side extending oil passage 32 (at the inside of the closed loop). Oil introduction ports 10*a* (see FIG. 2) of the intake-side lash adjustors 10 are connected to the oil supply ports 31*a*, so that the oil pressure is supplied to the intake-side lash adjustors 10 via the oil supply ports 31*a* and the oil introduction ports 10*a*. The valve clearance of each intake valve 1 is automatically adjusted by this oil pressure.

Likewise, eight, in total, oil supply ports 32*a* to supply the oil to the intake-side lash adjustors 11 at the exhaust-side valve drive portions 4 respectively open at a one side of the exhaust-side extending oil passage 32 which faces the intake-side extending oil passage 31 (at the inside of the closed loop). Oil introduction ports 11*a* of the exhaust-side lash adjustors 11 are connected to the oil supply ports 32*a*, so that the oil pressure is supplied to the exhaust-side lash adjustors 11 via the oil supply ports 32*a* and the oil introduction ports 11*a*. The valve clearance of each exhaust valve 2 is automatically adjusted by this oil pressure.

The variable valve drive mechanism 15 (see FIG. 2) to select the valve characteristics including the valve lift and the valve opening timing (the valve opening-start timing and the valve closing-end timing) is provided at either one of the intake-side valve drive portion 3 and the exhaust-side valve drive portion 4 (at the exhaust-side valve drive portion 4 in the present embodiment). This variable valve drive mechanism 15 is configured to select the valve characteristics with the operational oil supplied thereto through the exhaust-side lash adjustor 11 of the exhaust-side valve drive portion 4. While the structure of this mechanism 15 is known as disclosed in the above-described third patent publication or the like and its specific descriptions are omitted, as shown in FIG. 2, the oil pressure is supplied from the exhaust-side lash adjustor 11 to the variable valve drive mechanism 15 through an oil passage 4*b* formed inside the exhaust-side rocker arm 4*a*. This variable valve drive mechanism 15 selects the valve characteristics between a first valve characteristics and a second characteristics in accordance with the magnitude, i.e., large or small, of the oil pressure. This selection is conducted by ON or OFF switching of an oil-pressure control valve 51 in accordance with the engine running condition as described later.

When the oil pressure of the first specified value acts on the variable valve drive mechanism 15, the valve characteristics of the variable valve drive mechanism 15 become the first valve characteristics. Meanwhile, when the oil pressure of a second specified value or smaller, which is smaller than the first specified value, acts on the variable valve drive mechanism 15, the valve characteristics of the variable valve drive mechanism 15 become the second valve characteristics. Herein, the oil pressure necessary to maintain the valve clearances adjusted by the intake-side and exhaust-side lash adjustors 10, 11 at an appropriate value is a third specified value or larger, which is smaller than the second specified value.

To the inside-side extending oil passage 31 are connected four oil passages 37 to supply the lubricating oil to the intake camshaft 5. Each oil passage 37 is connected to a specified position between the two oil supply ports 31*a* (supplying the oil to the intake-side lash adjustor 10 at the two intake-side valve drive portions 3 to drive the two intake valves for each cylinder) for each cylinder, and extends obliquely upward and toward the exhaust-side extending oil passage 32 from this connection portion. Herein, an oil passage 38 which extends toward the opposite side to the exhaust-side extending oil passage 32 is connected to the engine's front-side end portion of the intake-side extending oil passage 31 (a tip-end opening of the oil passage 38 is closed), an oil passage 39 which extends engine-forward in parallel to the intake-side extending oil passage 31 is connected to the oil passage 38 (a tip-end opening of the oil passage 39 is closed), and a single oil passage 40 to supply the oil to the intake camshaft 5 is connected to the oil passage 39.

Likewise, to the exhaust-side extending oil passage 32 are connected four oil passages 43 to supply the lubricating oil to the exhaust camshaft 7. Each oil passage 43 is connected to a specified position between the two oil supply ports 32*a* (supplying the oil to the exhaust-side lash adjustor 11 at the two exhaust-side valve drive portions 4 to drive the two exhaust valves for each cylinder) for each cylinder, and extends obliquely upward and toward the intake-side extending oil passage 31 from this connection portion.

The above-described front-side oil passage 33 comprises vertical portions 33*a* which extend vertically at both end portions thereof and a connection pipe portion 33*b* which interconnects upper end portions of the vertical portions 33*a*. Lower end portions of the vertical portions 33*a* are connected to respective one-end portions (engine's front-side end portions) of the intake-side and exhaust-side extending oil passages 31, 32. Intake-side and exhaust-side shower pipes 47, 48 are connected to two positions around a central portion of the connection pipe portion 33*b*. These shower pipes 47, 48 extend in the cylinder arrangement direction above the intake-side and exhaust-side valve drive portions 3, 4 of the cylinders and eject the oil supplied through the front-side connection oil passage 33 as the lubricating oil over the valve drive portions 3, 4 from above.

Figure 3B:
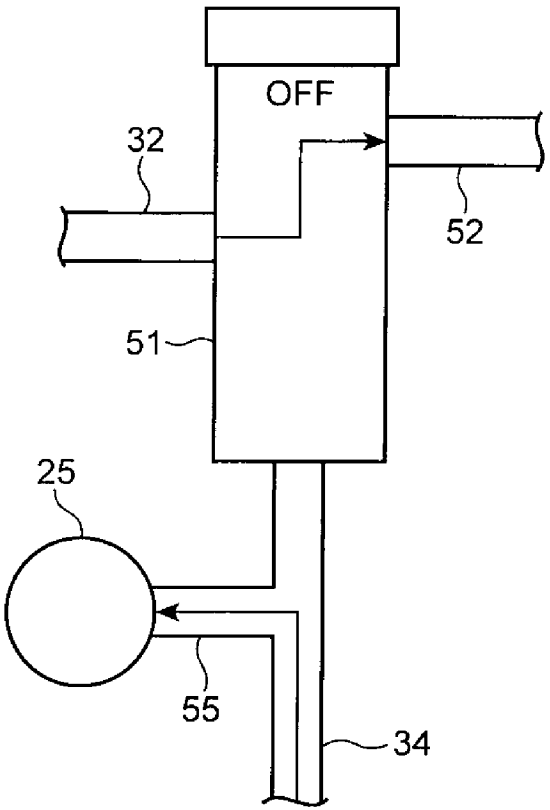
FIGS. 3A, B are schematic views showing an ON state and an OFF state of an oil-pressure control valve.
Figure 3A:
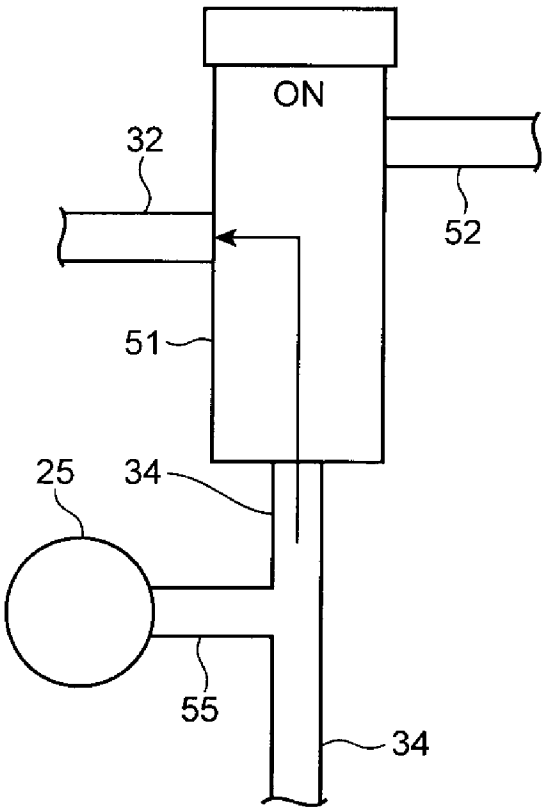

At a connection portion between the exhaust-side extending oil passage 32 and the rear-side connection oil passage 34 is arranged the oil-pressure control valve 51 to have the exhaust-side extending oil passage 32 connect to the rear-side connection oil passage 34 or a drain oil passage 52. This oil-pressure control valve 51 is comprised of a solenoid valve, and in its ON state, as shown in FIG. 3A, it makes the exhaust-side extending oil passage 32 connect to the rear-side connection oil passage 34. That is, a first state in which the exhaust-side extending oil passage 32 and the rear-side connection oil passage 34 do not connect to the drain oil passage 52 is formed. Meanwhile, when the oil-pressure control valve 51 is in its OFF state, as shown in FIG. 3B, a second state in which the exhaust-side extending oil passage 32 connects to the drain oil passage 52, whereas the exhaust-side extending oil passage 32 and the drain oil passage 52 do not connect to the rear-side connection oil passage 34 is formed.

At a specified portion of the rear-side connection oil passage 34 near the oil-pressure control valve 51, a supercharger connection oil passage 55 is connected to a turbocharger 25 to supercharge the intake air into the cylinders, and part of the oil supplied via the rear-side connection oil passage 34 is supplied to the turbocharger 25 through the supercharger connection oil passage 55 as the lubricating oil.

Figure 4:
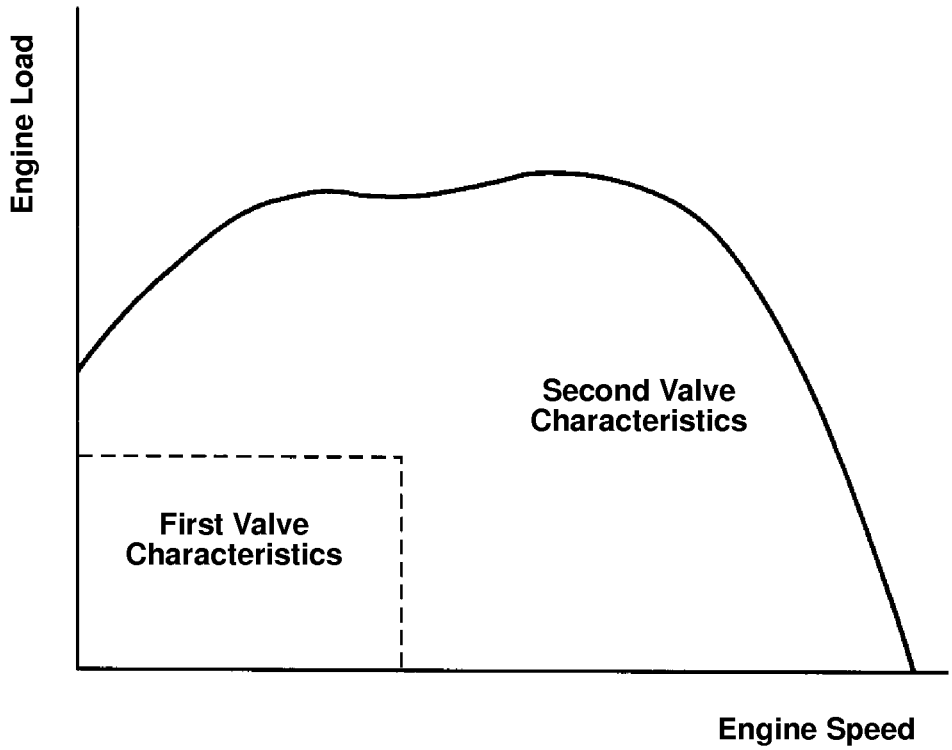
FIG. 4 is a characteristics map to set valve characteristics in accordance with an engine running condition.

As shown in FIG. 4, the oil-pressure control valve 51 is in the first state in which the exhaust-side extending oil passage 32 does not connect to the drain oil passage 52 at the low-load and low-speed engine running condition to select the valve characteristics to the first characteristics, whereas the oil-pressure control valve 51 is in the second state in which the exhaust-side extending oil passage 32 connects to the drain oil passage 52 at the other engine running condition to select the valve characteristics to the second characteristics.

In the above-described oil passage is provided an orifice 61 which partially narrows the sectional area of this oil passage (see FIGS. 1 and 2). That is, this orifice 61 is provided in the oil passage which is located on the side of the front-side connection oil passage 33 relative to a supply portion of the operational oil which is from the exhaust-side extending oil passage 32 and supplied to the exhaust-side lash adjustor 11 provided on the side of the foremost end portion (on the side of the one end portion) of the engine and located on the side of the front-side connection oil passage 33 relative to another supply portion of the operational oil which is supplied from the intake-side extending oil passage 31 to the intake-side lash adjustor 10 provided on the side of the foremost end portion (on the side of the one end portion) of the engine.

That is, in the present embodiment, the above-described orifice 61 is provided between the connection portion of the front-side connection oil passage 33 to the exhaust-side shower pipe 48 and the connection portion of the front-side connection oil passage 33 to the exhaust-side extending oil passage 32, so that when the oil-pressure control valve 51 is in the OFF state (the second state), the oil pressure of the exhaust-side extending oil passage 32 is adjusted to be the above-described third specified value or greater and the above-described second specified value or smaller. Herein, the orifice 61 may be provided in the vertical portion 33*a* connected to the exhaust-gas extending oil passage 32 in place of the present embodiment in which the orifice 61 is provided at the specified portion of the connection pipe portion 33*b* which is located on the side of the exhaust-side extending oil passage 32 relative to the connection portion to the exhaust-side shower pipe 48.

Figure 5:
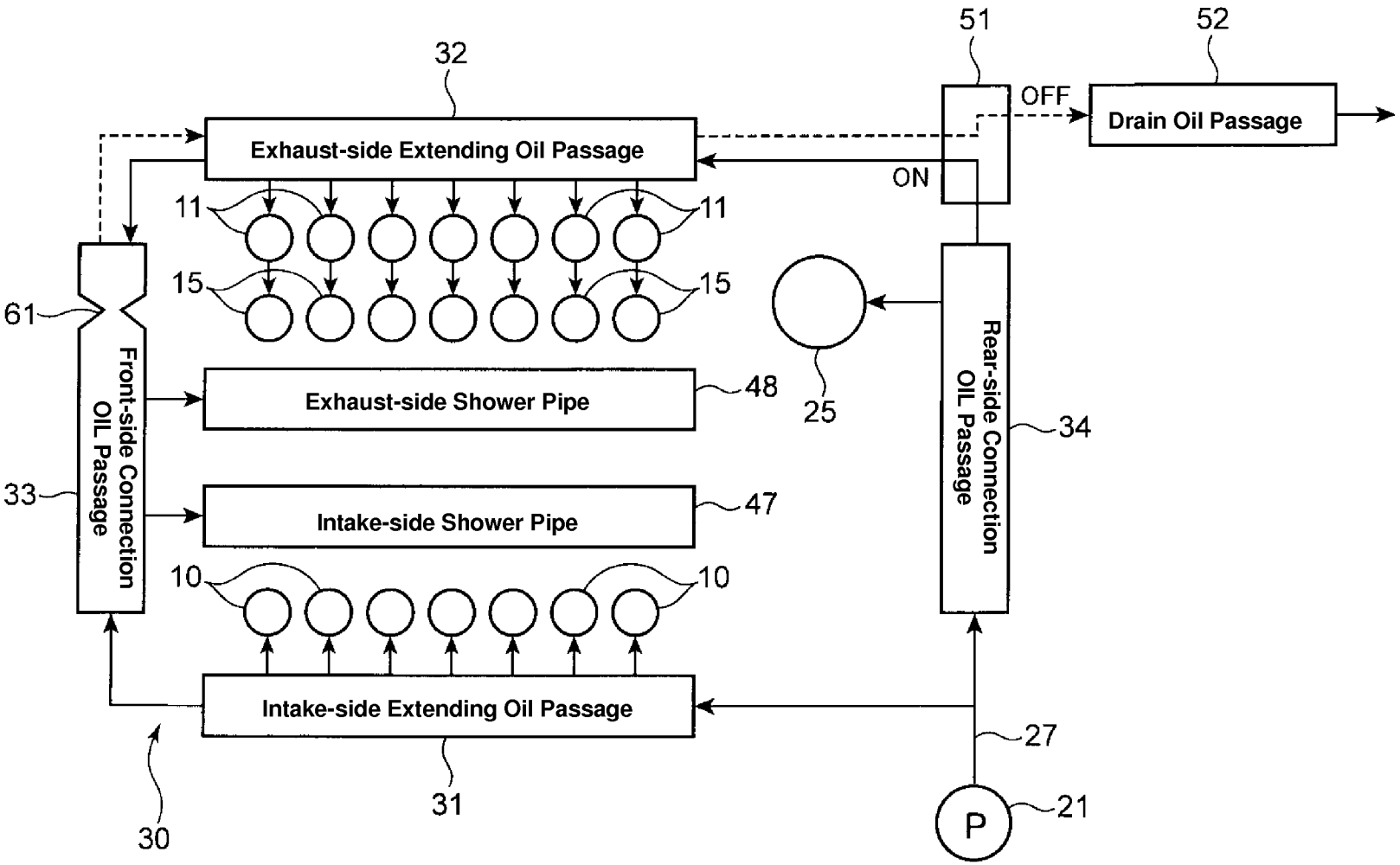
FIG. 5 is an explanatory diagram showing an oil flow in the oil supply device.

FIG. 5 shows an oil flow of the above-described oil supply device. An operation of the oil supply device will be described referring to this figure.

The oil discharged to the supply passage 27 by the oil pump 21 is supplied from the supply passage 27 to the intake-side oil passage 31 and the exhaust-side oil passage 34. The oil supplied to the intake-side extending oil passage 31 is then supplied from the oil supply ports 31*a* to the intake-side lash adjustors 10 of the intake-side valve drive portions 3 and the intake camshaft 5 via the oil passages 37-40. Further, the oil supplied to the front-side extending oil passage 33 from the intake-side extending oil passage 31 is supplied to the intake-side and exhaust-side shower pipes 47, 48 and then ejected over the intake-side and exhaust-side shower pipes 47, 48 via these shower pipes 47, 48 from above.

The rest of oil in the front-side connection oil passage 33 may tend to flow, passing through the orifice 61, into the exhaust-side extending oil passage 32. Herein, since in the first state with the ON state of the oil-pressure control valve 51 the exhaust-side extending oil passage 32 connects to the rear-side connection oil passage 34 as shown by the arrow illustrated by the solid line in FIG. 5, the oil is supplied to the rear-side extending oil passage 32 via the rear-side connection oil passage 34. The oil pressure of the rear-side extending oil passage 32 is the same as that of the intake-side extending oil passage 31, which is the above-described first specified value. Accordingly, the oil of the front-side connection oil passage 32 does not actually flow, passing through the orifice 61, into the exhaust-side extending oil passage 3. The oil supplied to the exhaust-side extending oil passage 32 is supplied from the oil supply ports 32*a* to the exhaust-side lash adjustors 11 of the exhaust-side valve drive portions 4, and then to the variable valve drive mechanisms 15 from the exhaust-side lash adjustors 11, and to the exhaust camshaft 7 via the oil passages 43.

Accordingly, in the ON state of the oil-pressure control valve 51 (the first state), the oil pressure of the first specified value is supplied to the intake-side lash adjustor 10, the exhaust-side lash adjustor 11, and the variable valve drive mechanism 15. Thereby, the valve characteristics adjusted by the variable valve drive mechanism 15 become the first valve characteristics. Further, the intake-side and exhaust-side lash adjustors 10, 11 can maintain the valve clearance at the appropriate value.

Meanwhile, in the second state with the OFF state of the oil-pressure control valve 51, as shown by the arrow illustrated by the broken line in FIG. 5, the exhaust-side extending oil passage 32 connects to the drain oil passage 52, whereas the exhaust-side extending oil passage 32 does not connect to the rear-side connection oil passage 34. Accordingly, the oil supplied from the rear-side connection oil passage 34 is not supplied to the exhaust-side extending oil passage 32, and the oil of the front-side connection oil passage 33 flows through the orifice 61 and then the oil supplied to the exhaust-side extending oil passage 32 flows down into the drain oil passage 52. Thus, while the oil pressure of the exhaust-side extending oil passage 32 decreases below the above-described first specified value, it can be kept at the specified pressure which is the above-described third specified value or greater and the above-described second specified value or smaller.

Accordingly, in the OFF state of the oil-pressure control valve 51 (the second state), the oil pressure of the first specified value is supplied to the intake-side lash adjustor 10, and the oil pressure which is the third specified value or greater and the second specified value or smaller is supplied to the exhaust-side lash adjustor 11 and the variable valve drive mechanism 15. Thereby, the valve characteristics adjusted by the variable valve drive mechanism 15 become the second valve characteristics. Further, the intake-side and exhaust-side lash adjustors 10, 11 can maintain the valve clearances at the appropriate value. Herein, the oil supplied to the exhaust-side connection oil passage 34 in the second state is supplied to the turbocharger 25 via the supercharger connection oil passage 55 as the lubricating oil.

As described above, the valve characteristics are selectable by the ON or OFF state of the oil-pressure control valve 51. Herein, when the oil-pressure control valve 51 is changed from the ON state to the OFF state for the selection from the first valve characteristics to the second valve characteristics, the exhaust-side extending oil passage 32 comes to connect to the drain oil passage 52, so that the oil pressure of the exhaust-side extending oil passage 32 decreases quickly from the above-described first specified value and drops to a level (below the above-described second specified value) to select the valve characteristics from the first valve characteristics to the second valve characteristics.

However, since the flow of the oil in the exhaust-side extending oil passage 32 is restricted (suppressed) by the orifice 61 having the narrow flow section so that the oil pressure for the exhaust-side lash adjustor 11 can be maintained at the third specified value or greater, the valve clearances can be kept at the appropriate value. Accordingly, the oil pressure of the exhaust-side extending oil passage 32 can be quickly dropped from the first specified value to the level to enable the selection to the second valve characteristics (which is the third specified value or greater and the second specified value or smaller), keeping the valve clearances at the appropriate value by the exhaust-side lash adjustor. Thus, the selection of the valve characteristics by the variable valve drive mechanism 15 can be conducted promptly.

On the other hand, when the oil-pressure control valve 51 is changed from the OFF state to the ON state for the selection of the valve characteristics from the second valve characteristics to the first valve characteristics, the connection of the exhaust-side extending oil passage 32 to the drain oil passage 52 is shut off. Thereby, the oil pressure supplied to the exhaust-side extending oil passage 32 can be increased to the first specified value quickly. Accordingly, the selection of the valve characteristics by the variable valve drive mechanism 15 can be conducted promptly in this case as well.

Further, according to the present embodiment, the intake-side and exhaust-side shower pipes 47, 48 which eject the operational oil supplied from the front-side connection oil passage 33 over the intake-side and exhaust-side valve drive portions 3, 4 from above are connected to a specified position of the front-side connection oil passage 33 which is located on the intake-side extending oil passage 31 relative to the orifice 61. Thereby, even in case the exhaust-side connection oil passage 33 connects to the drain oil passage 52, the oil pressure of the connection portion between the front-side connection oil passage 33 and the shower pipes 47, 48 can be maintained at the first specified value, so that the oil can be properly supplied to the shower pipes 47, 48.

Also, when the oil-pressure control valve 51 is changed from the OFF state to the ON state to make the exhaust-side extending oil passage 32 connect to the rear-side connection oil passage 34 by shutting off the connection between the rear-side connection oil passage 34 connecting the other end portion (the engine's rear-side end portion) of the intake-side extending oil passage 31 and the drain oil passage 52 like the present embodiment, the oil pressure of the first specified value can be promptly supplied to the variable valve drive mechanism 15 from the rear-side connection oil passage 34 via the exhaust-side extending oil passage 32 and the exhaust-side lash adjustor 11. Accordingly, the selection of the valve characteristics by the variable valve drive mechanism 15 can be more quickly executed.

Moreover, according to the present embodiment, in the oil supply device of an engine which comprises the rear-side connection oil passage 34 connecting the other end portion of the intake-side extending oil passage 31 and the disposition portion of the oil-pressure control vale 51 and the supercharger 25 provided on the side of the exhaust-side extending oil passage 32 and supercharging the intake air to the cylinders, since the supercharger connection oil passage 55 to supply the oil from the rear-side connection oil passage 34 to the supercharger 25 is provided, the oil can be easily and properly supplied as the lubricating oil from the exhaust-side extending oil passage 32 to the supercharger 25 via the supercharger connection oil passage 55 in the first state in which the connection of the exhaust-side extending oil passage 32 to the drain oil passage 52 is shut off. Also, even when the selection of the valve characteristics by the oil-pressure control valve 51, the proper oil supply to the supercharger 25 can be conducted. While the oil pressure of the exhaust-side extending oil passage 32 changes in accordance with the selection of the valve characteristics by the oil-pressure control valve, the change of the oil pressure of the rear-side connection oil passage 34 is so small that the supply of the lubricating oil to the supercharger can be conducted properly.

Further, in the present embodiment, the above-described first state in which the connection between the exhaust-side extending oil passage 32 and the drain oil passage 52 is shut off is set at the low-load and low-speed engine running condition, and the above-described second state in which the exhaust-side extending oil passage 32 and the drain oil passage 52 are connected to each other is set at the other engine running condition. Thereby, the oil can be properly supplied to the various portions in accordance with the engine running condition. That is, the exhaust-side extending oil passage 32 equipped with the variable valve drive mechanism 15 requires the oil pressure when the engine running is in the low-speed state. Meanwhile, the supercharger 25 requires lots of lubricating oil when the engine running is in the high-speed state. Thus, the engine speeds of the engine running condition where the exhaust-side extending oil passage 32 equipped with the variable valve drive mechanism 15 or the supercharger 25 wants the oil are different from each other, so that the oil supply to the supercharger 25 can be restrained from being delayed when the engine running condition is changed from the first state to the second state, in particular.

While the present embodiment shows an example in which the exhaust-side extending oil passage 32 corresponds to the first extending oil passage, the intake-side extending oil passage 31 corresponds to the second extending oil passage, the rear-side connection oil passage 34 corresponds to the second connection oil passage, the present invention should not be limited to the present embodiment described above, and any other modifications and improvements may be applied within the scope of a sprit of the present invention.

For example, the supply oil passage 27 may be connected to any portion of the intake-side extending oil passage 31 as long as the variable valve drive mechanism 15 is provided at the exhaust-side valve drive portion 4, instead of the present embodiment in which it is connected to the engine rear-side end portion of the intake-side extending oil passage 31. Or, in the case of the oil-pressure control valve 51 and the orifice 61 being arranged as described above, the supply oil passage 27 may be connected to the rear-side connection oil passage 34, or to a specified portion of the front-side connection oil passage 33 which is located on the intake-side extending oil passage 31 relative to the orifice 61.

Further, while the present embodiment shows an example in which the orifice 61 is provided between the connection portion of the front-side connection oil passage 33 to the exhaust-side shower pipe 48 and the connection portion to the exhaust-side extending oil passage 32, any other modifications may be applied within the scope of the present invention in which the orifice 61 is provided in the oil passage which is located on the side of the first connection oil passage (the front-side connection oil passage 33) relative to the supply portion of the operational oil supplied to the exhaust-side lash adjustor 11 provided on the side of the one end portion of the first extending oil passage (the exhaust-side extending oil passage 32) and located on the side of the first connection oil passage (the front-side connection oil passage 33) relative to the supply portion of the operational oil supplied to the intake-side lash adjustor 10 provided on the side of the one end portion of the second extending oil passage (the intake-side extending oil passage 31).

For example, as long as the variable valve drive mechanism 15 is provided at the exhaust-side valve drive portion 4 and the oil-pressure control valve 51 is provided at the connection portion between the exhaust-side oil passage 32 and the front-side connection oil passage 33, the orifice 61 may be provided at the engine front-side end portion of the exhaust-side extending oil passage 32, i.e., a specified portion on the engine front side relative to the oil supply port 32*a* for the exhaust-side lash adjustor 11 located on the engine foremost side (on the side of the one end portion). Or, the orifice 61 may be provided at a specified portion of the front-side connection oil passage 33 between the intake-side and exhaust-side shower pipes 47, 48, or at a specified portion between the connection portion to the intake-side shower pipe 47 and the connection to the intake-side extending oil passage 31. However, it may be preferable that the orifice 61 be provided at the position in the above-described embodiment or the engine front-side end portion of the exhaust-side extending oil passage 32 (on the engine front side relative to the engine foremost oil supply port 32*a*) in order to achieve the better oil supply to the shower pipes 47, 48.

Moreover, while according to the present embodiment the oil-pressure control valve 51 is provided at the connection portion between the exhaust-side extending oil passage 32 and the rear-side connection oil passage 34, the orifice 61 is provided at the front-side connection oil passage 33, and the intake-side and exhaust-side shower pipes 47, 48 are connected, the oil-pressure control valve 51 may be provided at the connection portion between the exhaust-side extending oil passage 32 and the front-side connection oil passage 33 and the shower pipes 47, 48 may be connected to the rear-side connection oil passage 34 as long as the variable valve drive mechanism 15 is provided at the exhaust-side valve drive portion 4. In this case, it may be preferable that the orifice 61 be provided at a portion of the rear-side connection oil passage 34 between the connection portion to the exhaust-side shower pipe 48 and the connection portion to the exhaust-side extending oil passage 32, or at the engine rear-side end portion of the exhaust-side extending oil passage 32 (at a specified portion on the engine rear side relative to the engine's rearmost oil support port 32*a*).

Further, the variable valve drive mechanism 15 may be provided at the intake-side valve drive portion 3 in place of the exhaust-side valve drive mechanism 4. In this case, the variable valve drive mechanism 15 selects the valve characteristics with the operational oil supplied through the intake-side lash adjustor 10 of the intake-side valve drive portion 3. And, it can be configured such that the oil-pressure control valve 51 is provided at the connection portion between the intake-side extending oil passage 31 and the front-side connection oil passage 33, the orifice 61 is provided in the rear-side connection oil passage 34, and the shower pipes 47, 48 are connected. Or, it may be configured such that the variable valve drive mechanism 15 is provided at the connection portion between the intake-side extending oil passage 31 and the rear-side connection oil passage 34, the orifice 61 is provided in the front-side connection oil passage 33, and the shower pipes 47, 48 are connected. In this case, the supply oil passage 27 can be connected to the exhaust-side extending oil passage 32 or the like.

What is claimed is:

1. An oil supply device of an engine, comprising:

lash adjustors respectively provided at valve drive portions located on an intake side and an exhaust side of a cylinder;

a first extending oil passage supplying operational oil to one of said lash adjustors;

a second extending oil passage supplying operational oil to the other of said lash adjustors;

a first connection oil passage interconnecting respective one end portions of said first and second extending oil passages;

a variable valve-drive mechanism selecting valve characteristics by using the operational oil supplied through said one of the lash adjustors;

an oil-pressure control valve provided at the other end portion of said first extending oil passage and selecting a first state in which the first extending oil passage does not connect to a drain oil passage or a second state in which the first extending oil passage connects to the drain oil passage; and an orifice provided in an oil passage which is located on the side of said first connection oil passage relative to a supply portion of the operational oil supplied to the one of said lash adjustors provided on the side of the one end portion of said first extending oil passage and located on the side of said first connection oil passage relative to another supply portion of the operational oil supplied to the other of said lash adjustors provided on the side of the one end portion of said second extending oil passage.

2. The oil supply device of an engine of claim 1, further comprising shower pipes ejecting the operational oil supplied from said first connection oil passage over said valve drive portions from above, wherein said orifice is provided on the side of said first extending oil passage relative to connection portions between the shower pipes and the first connection oil passage.

3. The oil supply device of an engine of claim 2, further comprising a second connection oil passage interconnecting the other end portion of said second extending oil passage and a disposition portion of said oil-pressure control valve, wherein said second connection oil passage connects to the other end portion of said first extending oil passage in said first state.

4. The oil supply device of an engine of claim 2, further comprising a second connection oil passage interconnecting the other end portion of said second extending oil passage and a disposition portion of said oil-pressure control valve, a supercharger provided on the side of said first extending passage to supercharge intake air supplied into the cylinder, and a supercharger connection oil passage connecting said second connection oil passage and the supercharger.

5. The oil supply device of an engine of claim 4, wherein said first state is set at a low-load and low-speed engine running condition, and said second state is set at the other engine running condition.

6. The oil supply device of an engine of claim 1, further comprising a second connection oil passage interconnecting the other end portion of said second extending oil passage and a disposition portion of said oil-pressure control valve, wherein said second connection oil passage connects to the other end portion of said first extending oil passage in said first state.

7. The oil supply device of an engine of claim 6, further comprising a supercharger provided on the side of said first extending passage to supercharge intake air supplied into the cylinder and a supercharger connection oil passage connecting said second connection oil passage and the supercharger.

8. The oil supply device of an engine of claim 7, wherein said first state is set at a low-load and low-speed engine running condition, and said second state is set at the other engine running condition.

9. The oil supply device of an engine of claim 1, further comprising a second connection oil passage interconnecting the other end portion of said second extending oil passage and a disposition portion of said oil-pressure control valve, a supercharger provided on the side of said first extending passage to supercharge intake air supplied into the cylinder, and a supercharger connection oil passage connecting said second connection oil passage and the supercharger.

10. The oil supply device of an engine of claim 9, wherein said first state is set at a low-load and low-speed engine running condition, and said second state is set at the other engine running condition.

* * * * *